US008578734B2

(12) United States Patent
Jager

(10) Patent No.: US 8,578,734 B2
(45) Date of Patent: Nov. 12, 2013

(54) METHOD AND APPARATUS FOR LIQUEFYING A HYDROCARBON STREAM

(75) Inventor: Marco Dick Jager, The Hague (NL)

(73) Assignee: Shell Oil Company, Houston, TX (US)

( * ) Notice: Subject to any disclaimer, the term of this patent is extended or adjusted under 35 U.S.C. 154(b) by 1194 days.

(21) Appl. No.: 12/300,722

(22) PCT Filed: Apr. 16, 2007

(86) PCT No.: PCT/EP2007/053681
§ 371 (c)(1),
(2), (4) Date: Nov. 13, 2008

(87) PCT Pub. No.: WO2007/131850
PCT Pub. Date: Nov. 22, 2007

(65) Prior Publication Data

US 2009/0095019 A1 Apr. 16, 2009

(30) Foreign Application Priority Data

May 15, 2006 (EP) ..... 06113923

(51) Int. Cl.
*F25J 5/00* (2006.01)
*F25J 1/00* (2006.01)

(52) U.S. Cl.
USPC ..... 62/613; 62/611; 62/612

(58) Field of Classification Search
USPC ..... 62/612, 613, 611, 614
See application file for complete search history.

(56) References Cited

U.S. PATENT DOCUMENTS 2,930,202 A * 3/1960 Yendall ..... 62/646
3,203,191 A 8/1965 French ..... 62/9
3,274,787 A 9/1966 Grenier et al. ..... 62/35

(Continued)

FOREIGN PATENT DOCUMENTS

DE 19821242 11/1999
EP 1008823 9/2004

(Continued)

OTHER PUBLICATIONS

Paradowski, H, et al: "High Efficiency 6 MTPA LNG Train Design via Two Different Mixed Refrigerant Processes", AICHE National Meeting, Mar. 10, 2002, pp. 245-247.

(Continued)

*Primary Examiner* — Ljiljana Ciric
*Assistant Examiner* — Alexis Cox

(57) ABSTRACT

A method of liquefying a hydrocarbon stream such as natural gas from a feed stream, the method at least comprising the steps of: (a) providing a feed stream (10); (b) dividing the feed stream (10) of step (a) to provide at least a first feed stream (20) comprising at least 90 mass % of the initial feed stream (10), and a second feed stream (30); (c) liquefying the first feed stream (20) of step (b) at a pressure between 20-100 bar to provide a first liquefied natural gas (LNG) stream (40); (d) cooling the second feed stream (30) of step (b) to provide a cooled feed stream (50); (e) combining the first LNG stream (40) of step (c) with the cooled feed stream (50) of step (d) to provide a combined LNG stream (60); (f) reducing the pressure of the combined LNG stream (60) of step (e); and (g) passing the combined LNG stream (60) of step (f) through a flash vessel (12) to provide a product LNG stream (70) and a gaseous stream (80).

21 Claims, 1 Drawing Sheet

(56) References Cited

U.S. PATENT DOCUMENTS

| | | | | | |
|---|---|---|---|---|---|
| 3,535,885 | A | * | 10/1970 | Frijlink Willem et al. | 62/614 |
| 3,616,652 | A | * | 11/1971 | Engel | 62/613 |
| 3,702,063 | A | * | 11/1972 | Etzbach et al. | 62/612 |
| 3,792,590 | A | * | 2/1974 | Lofredo et al. | 62/614 |
| 4,033,735 | A | | 7/1977 | Swenson | 62/9 |
| 4,112,700 | A | | 9/1978 | Forg | |
| 4,155,729 | A | * | 5/1979 | Gray et al. | 62/621 |
| 4,407,135 | A | * | 10/1983 | Pahade | 62/650 |
| 4,541,852 | A | | 9/1985 | Newton et al. | 62/11 |
| 4,548,629 | A | | 10/1985 | Chiu | 62/17 |
| 5,421,165 | A | | 6/1995 | Paradowski et al. | |
| 5,613,373 | A | | 3/1997 | Grenier | |
| 5,669,234 | A | | 9/1997 | Houser et al. | 62/612 |
| 5,701,761 | A | * | 12/1997 | Prevost et al. | 62/613 |
| 5,890,378 | A | | 4/1999 | Rambo et al. | 62/621 |
| 5,943,881 | A | | 8/1999 | Grenier | |
| 6,041,620 | A | * | 3/2000 | Olszewski et al. | 62/612 |
| 6,105,391 | A | | 8/2000 | Capron | 62/613 |
| 6,116,050 | A | | 9/2000 | Yao et al. | 62/630 |
| 6,237,365 | B1 | * | 5/2001 | Trebble | 62/621 |
| 6,250,105 | B1 | | 6/2001 | Kimble | |
| 6,333,445 | B1 | * | 12/2001 | O'Brien | 585/809 |
| 6,378,330 | B1 | | 4/2002 | Minta et al. | 62/613 |
| 6,401,486 | B1 | | 6/2002 | Lee et al. | 62/630 |
| 6,591,632 | B1 | * | 7/2003 | Mahoney | 62/613 |
| 6,658,892 | B2 | | 12/2003 | Fanning et al. | 62/613 |
| 6,898,949 | B2 | | 5/2005 | Paradowski | |
| 7,051,553 | B2 | | 5/2006 | Mak et al. | 62/636 |
| 2002/0042550 | A1 | | 4/2002 | Pironti et al. | 585/800 |
| 2003/0177785 | A1 | * | 9/2003 | Kimble et al. | 62/613 |
| 2004/0079107 | A1 | | 4/2004 | Wilkinson et al. | 62/611 |
| 2004/0177646 | A1 | * | 9/2004 | Wilkinson et al. | 62/614 |
| 2005/0056051 | A1 | | 3/2005 | Roberts et al. | 62/612 |
| 2005/0155381 | A1 | | 7/2005 | Yang et al. | 62/620 |
| 2007/0012071 | A1 | | 1/2007 | Huang et al. | 62/612 |
| 2007/0012072 | A1 | | 1/2007 | Qualls et al. | 62/613 |
| 2007/0062216 | A1 | | 3/2007 | Mak et al. | |
| 2008/0016910 | A1 | | 1/2008 | Brostow et al. | 62/630 |

FOREIGN PATENT DOCUMENTS

| | | |
|---|---|---|
| EP | 1469266 | 10/2004 |
| WO | WO02101307 | 12/2002 |
| WO | WO03106906 | 12/2003 |
| WO | WO2004109180 | 12/2004 |
| WO | WO2005045338 | 5/2005 |
| WO | WO2009101127 | 8/2009 |

OTHER PUBLICATIONS

Schoenmakers, PJ, et al:: "Comparison of comprehensive two-dimensional gas chromatography and gas chromatography—mass spectrometry for the characterization of complex hydrocarbon mixtures", Journal of Chromatograph A, 892 92000) pp. 29-46.

* cited by examiner

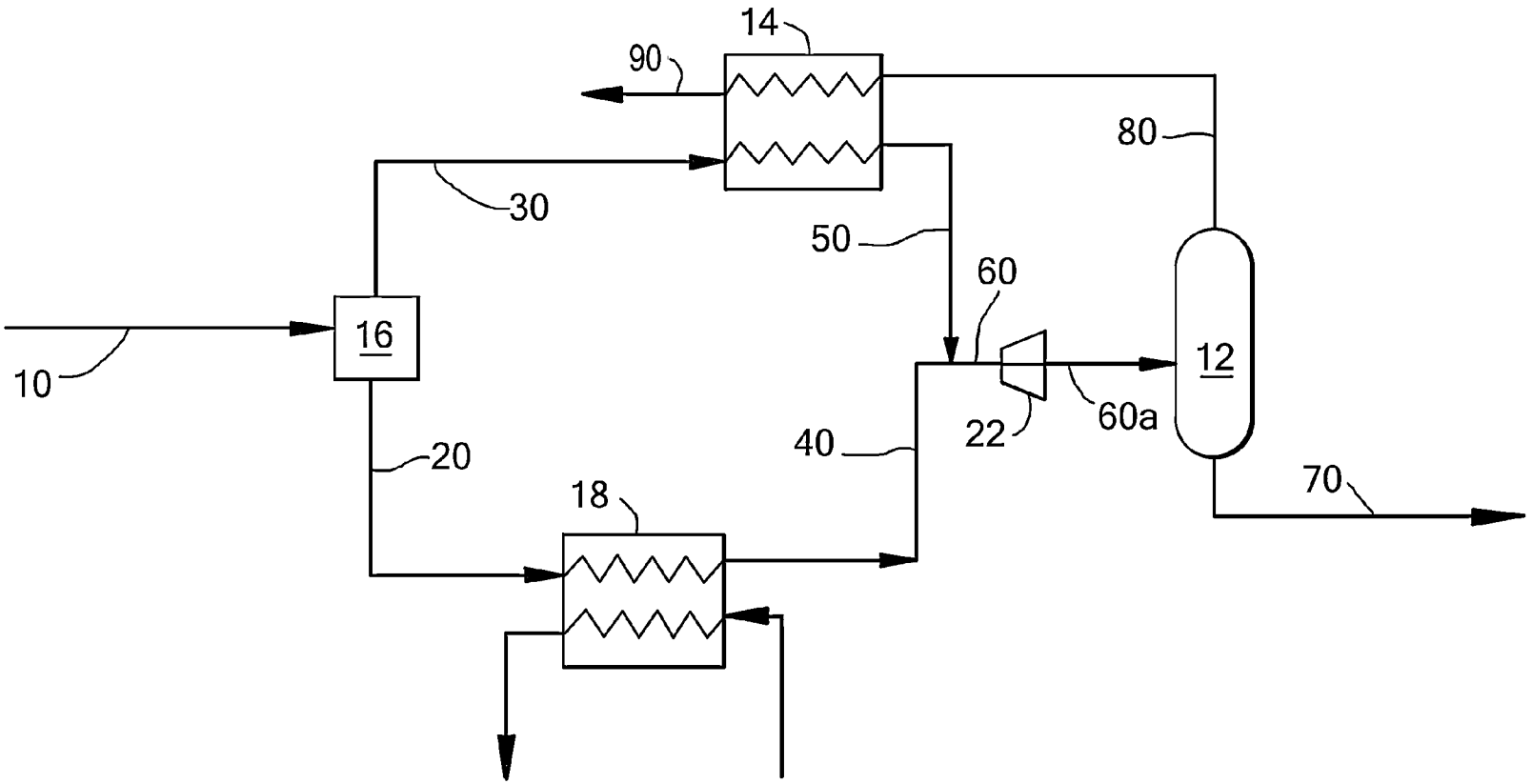
10
16
30
20
14
90
18
50
40
60
22
60a
80
12
70

METHOD AND APPARATUS FOR LIQUEFYING A HYDROCARBON STREAM

The present application claims priority from European Patent Application 06113923.4 filed 15 May 2006.

FIELD OF THE INVENTION

The present invention relates to a method and apparatus for liquefying a hydrocarbon stream such as natural gas.

BACKGROUND OF THE INVENTION

Several methods of liquefying a natural gas stream thereby obtaining liquefied natural gas (LNG) are known. It is desirable to liquefy a natural gas stream for a number of reasons. As an example, natural gas can be stored and transported over long distances more readily as a liquid than in gaseous form because it occupies a smaller volume and does not need to be stored at high pressures.

Usually natural gas, comprising predominantly methane, enters an LNG plant at elevated pressures and is pre-treated to produce a purified feed stock suitable for liquefying at cryogenic temperatures. The purified gas is processed through a plurality of cooling stages using heat exchangers to progressively reduce its temperature until liquefaction is achieved. The liquid natural gas is then further cooled (to reduce flashed vapour through one or more expansion stages) to final atmospheric pressure suitable for storage and transportation. The flashed vapour from each expansion stage can be used as a source of plant fuel gas.

The costs in creating and running a liquefying natural gas (LNG) plant or system are naturally high, and much is for the cooling configurations. Thus any reduction in the energy requirements of the plant or system has significant cost benefit. Reducing the cost of the cooling configuration is particularly advantageous.

U.S. Pat. No. 4,541,852 is directed to a base load LNG system, and shows a slip stream of feed natural gas which is reintroduced into the liquefied natural gas stream after the liquefied natural gas stream is reduced in pressure through a valve. This has the problem of not fully utilising available work from the feed natural gas.

SUMMARY OF THE INVENTION

It is an object to minimise the above problem, and to improve the efficiency of a liquefying plant or system.

It is a further object of the present invention to simplify the use of vapour from a flash tank, and thereby reduce the energy requirements of a liquefying plant or system.

One or more of the above or other objects can be achieved by the present invention providing a method of liquefying a hydrocarbon stream such as natural gas from a feed stream, the method at least comprising the steps of:

(a) providing a feed stream;

(b) dividing the feed stream of step (a) to provide at least a first feed stream comprising at least 90 mass % of the initial feed stream (10), and a second feed stream;

(c) liquefying the first feed stream of step (b) at a pressure between 20-100 bar to provide a first liquefied natural gas (LNG) stream;

(d) cooling the second feed stream of step (b) through a heat exchanger to provide a cooled feed stream;

(e) combining the first LNG stream of step (c) with the cooled feed stream of step (d) to provide a combined LNG stream;

(f) reducing the pressure of the combined LNG stream of step (e); and (g) passing the combined LNG stream of step (f) through a flash vessel to provide a product LNG stream and a gaseous stream.

BRIEF DESCRIPTION OF THE DRAWINGS

An embodiment of the present invention will now be described by way of example only, and with reference to the accompanying non-limiting drawing in which:

FIG. 1 is a general scheme of part of an LNG plant according to one embodiment of the present invention.

DETAILED DESCRIPTION OF THE INVENTION

An advantage of the present invention is to increase the work energy available, by the reduction of pressure of the combined LNG stream.

Another advantage of the present invention is to reduce the energy requirement of the flash vessel by combining the first LNG stream and cooled feed stream prior to reduction of their pressure and introduction into the flash vessel.

Moreover, hitherto, the cold (energy) of the flashed vapour from the expansion or end flash stages has usually only been recovered in one or more heat exchangers by cooling down a fraction of a refrigerant stream, usually a Light Mixed Refrigerant (LMR) stream in a countercurrent heat exchanger. In this way, the end flash gas is brought from a temperature level of about −160° C. to only about −40° C., such that the full cold of the end flash gas is not recovered. The cooled LMR stream is then used in one or more other heat exchangers to cool another stream in the plant or system.

The hydrocarbon stream may be any suitable gas stream to be treated, but is usually a natural gas stream obtained from natural gas or petroleum reservoirs. As an alternative the natural gas stream may also be obtained from another source, also including a synthetic source such as a Fischer-Tropsch process.

Usually the natural gas stream is comprised substantially of methane. Preferably the feed stream comprises at least 60 mol % methane, more preferably at least 80 mol % methane.

Depending on the source, the natural gas may contain varying amounts of hydrocarbons heavier than methane such as ethane, propane, butanes and pentanes as well as some aromatic hydrocarbons. The natural gas stream may also contain non-hydrocarbons such as $H_2O$, $N_2$, $CO_2$, $H_2S$ and other sulphur compounds, and the like.

If desired, the feed stream may be pre-treated before using it in the present invention. This pre-treatment may comprise removal of undesired components such as $CO_2$ and $H_2S$, or other steps such as pre-cooling, pre-pressurizing or the like. As these steps are well known to the person skilled in the art, they are not further discussed here.

The division of the feed stream could be provided by any suitable divider, for example a stream splitter. Preferably the division creates two streams having the same composition and phases.

The flash vessel may be any suitable vessel for obtaining a product LNG stream and a gaseous stream. Such vessels are known in the art.

The person skilled in the art will understand that the step of reducing the pressure may be performed in various ways using any expansion device (e.g. using a flash valve or a common expander) or any combination of same. Preferably, the reduction in pressure is carried out by a two phase expander or expanders.

Although the method according to the present invention is applicable to various hydrocarbon feed streams, it is particularly suitable for natural gas streams to be liquefied. As the skilled person readily understands how to liquefy a hydrocarbon stream, this is not further discussed here.

The liquefaction of the first feed stream is preferably carried out between 40-80 bar. Also preferably, there is no real or significant pressure change (other than any de minimus or normal operational change, for example 10 bar or less) of the first feed stream between its separation and recombination with the second feed stream.

The product LNG stream is preferably at a low pressure such as 1-10 bar, more preferably 1-5 bar, even more preferably ambient pressure. The person skilled in the art will readily understand that after liquefaction, the liquefied natural gas may be further processed, if desired. As an example, the obtained LNG may be depressurized by means of a Joule-Thomson valve or by means of a cryogenic turbo-expander. Also, further intermediate processing steps between the gas/liquid separation in the first gas/liquid separator and the liquefaction may be performed.

In the present invention, the gaseous stream of step (g) could be directly used to provide part, substantial or whole cooling for any part, stream, unit, stage or process of a liquefying plant or system. This could be carried out possibly as one cooling stream or as multiple cooling streams, either in parallel or serially. This could include at least part of the liquefying of the first feed stream, or indeed any feed stream. It could also include cooling a refrigerant. This could be carried out by passing the gaseous stream of step (g) through one or more heat exchangers.

Thus, the gaseous stream from the flash vessel can advantageously provide direct cooling of a feed stream without requiring any intermediate refrigerant processes or streams.

A further advantage of the present invention is that more cold recovery is possible from the gaseous stream, increasing the efficiency of the cold recovery and therefore further reducing the energy requirements of the overall liquefying plant.

In one embodiment of the present invention, the method further comprises the step of;

(h) passing the second feed stream and the gaseous stream through a heat exchanger to at least partly provide the cooling of the second feed stream in step (d).

An advantage of this embodiment is that the second feed stream does not require a separate cooling system or apparatus, reducing the plant installation and energy requirements.

Preferably, the method of the present invention further comprises the step of:

(i) using the outward gaseous stream provided from the passage of the input gaseous stream through the or any heat exchanger as a fuel gas stream.

An advantage of this embodiment is that the gaseous stream is still a useable product in a overall plant, without recycle to the feed stream.

Typically, the second stream is cooled to a temperature sufficient to provide a combined LNG stream upon combining the cooled feed stream with the first LNG stream.

Generally, the second stream is cooled by the heat exchange in step (d) to a temperature of at least −100° C., and preferably the same or similar temperature to that of the first LNG stream.

The division of the feed stream containing the natural gas can be any ratio or ratios between the two or more streams formed by step (b) as long as there is one stream comprising at least 90 mass % of the feed stream. Generally, there are two feed streams created, and the smaller stream could be regarded as a 'bypass stream'. In one embodiment of the present invention, the first feed stream comprises at least 95 mass %, preferably at least 97 mass %, of the initial feed stream. In the alternative, the second feed stream is between 1-5 mass % of the feed stream containing natural gas, preferably between 2-3 mass % of the feed stream.

Coming from the endflash of the LNG production process, the gaseous stream (which stream may also be termed a reject gas stream) generally has a temperature between −150° C. and −170° C., usually about −160° C. to −162° C. The temperature of the gaseous stream after passing through a heat exchanger will preferably become above 0° C., preferably following any heat exchange with the second feed stream.

Preferably, the gaseous stream is heated to a temperature between 30° C. and 50° C., more preferably between 35° C. and 45° C. by any heat exchange. Where the gaseous stream is used as a fuel gas, its temperature is not critical, such that a temperature of +40° C. is acceptable.

By being able to raise the temperature of the gaseous stream beyond the current −40° C. temperature, which is the maximum cold recovery possible when heat exchanging with current refrigerant streams such as an LMR stream, there are two further benefits. Firstly, the heat exchanger, in particular the cold recovery exchange area, can be smaller, possibly 20% or 30% smaller than the current usual design of heat exchanger for the reject gas from an end flash vessel. Thus, the heat exchange area in a typical heat exchanger could be less than 2500 $m^2$, preferably less than 2000 $m^2$.

Secondly, by being able to increase the resultant temperature of the gaseous stream through a heat exchanger from the present maximum of −40° C. (based on refrigerants used) to a temperature of typically more than +20° C., preferably +30° C., more preferably +40° C. or more, this energy can be used to reduce the energy required for cooling or refrigeration elsewhere in the plant or system, such as the refrigerant compressor power used for one or more other feed streams or LNG streams in the plant. It is estimated that for an LNG plant having a capacity of approximately 5 Mtpa, the cold recovery exchanger duty of the usual heat exchanger for the gaseous stream from the end flash vessel can be doubled, leading to a reduction of the main refrigerant compressor power of 1% or more. A reduction of 1% in the main compression power is significant for industrial liquefaction plants, for example those of 1 Mtpa output or more.

The liquefying in step (c) can involve one or more cooling and/or liquefying stages. This could involve a pre-cooling stage and a main cooling stage. The pre-cooling stage could involve cooling the feed stream against a refrigerant in a refrigerant circuit.

Typically, the main cooling stage has a separate refrigeration circuit, and generally includes one or more separate refrigerant compressors. A non-limiting example of a typical main refrigerant is a mixture of compounds having different boiling points in order to obtain a well-distributed heat transfer. One mixture is nitrogen, ethane and propane.

In a further aspect, the present invention provides apparatus for producing a liquefied hydrocarbon stream such as natural gas from a feed stream, the apparatus at least comprising:

a stream splitter to divide the feed stream into at least a first feed stream comprising at least 90 mass % of the initial feed stream, and a second feed stream;

a liquefying system including at least one heat exchanger for liquefying the first feed stream at a pressure between 20-100 bar to provide a first liquefied natural gas (LNG) stream;

a heat exchanger to at least partly cool the second feed stream to provide a cooled feed stream;

a combiner to combine the first LNG stream and the cooled feed stream;

an expander to reduce the pressure of the combined LNG stream; and a flash vessel to provide a product LNG stream and a gaseous stream.

Preferably, the gaseous stream from the flash vessel is passed through a conduit to a heat exchanger. After passage through the heat exchanger the gaseous stream could be used as a fuel gas stream.

The combiner may be any suitable arrangement, generally involving a union or junction or piping or conduits, optionally involving one or more valves.

An embodiment of the present invention will now be described by way of example only, and with reference to the accompanying non-limiting drawing in which:

FIG. 1 is a general scheme of part of an LNG plant according to one embodiment of the present invention.

FIG. 1 shows a general arrangement of part of a liquid natural gas (LNG) plant. It shows an initial feed stream containing natural gas 10. In addition to methane, natural gas includes some heavier hydrocarbons and impurities, e.g. carbon dioxide, nitrogen, helium, water, mercaptans, mercury and non-hydrocarbon acid gases. The feed stream is usually pre-treated by methods known in the art to separate out these impurities as far as appropriate to meet LNG quality specifications; to prevent fouling/damage to equipment downstream and to prevent ice formation in equipment downstream feed stream 10. Preferably, at least carbon dioxide, water, mercaptans, mercury and non-hydrocarbon acid gases are removed from feed stream 10 to provide a purified feed stock suitable for liquefying at cryogenic temperatures.

The feed stream 10 is divided by stream splitter 16 to divide the feed stream 10 into at least two further feed streams 20, 30 having wholly or substantially the same composition, i.e. the same components and phase or phases. The feed stream (10) can be divided into more than two feed streams where desired or necessary.

In FIG. 1, 90 mass % or more of the feed stream 10 provides a first feed stream 20, generally being at least 95 mass % of the feed stream 10, preferably more than 97 mass %. This first feed stream 20 is liquefied at a pressure between 20-100 bar and preferably between 50-60 bar such as 55 bar, by a liquefaction system. Liquefaction systems are known in the art, and may include one or more cooling and/or refrigeration processes, generally including at least one heat exchanger 18. Such means are well known in the art, and are not described further herein. The liquefaction system provides a first LNG stream 40, preferably having the same or similar pressure as the first feed stream 20.

Meanwhile, the second feed stream 30 created by the stream splitter 16 is passed through another heat exchanger 14. Heat exchangers are well known in the art, and generally involve the passage of at least two streams therethrough, wherein cold energy from one stream is recovered to cool and/or refrigerate at least one other stream running cocurrently or countercurrently to the first stream. In FIG. 1, the heat exchanger 14 cools the second feed stream 30 to produce a cooled feed stream 50. Typically the cooled feed stream 50 is LNG.

The heat exchanger 14 could comprise more than one heat exchanger to cool the second feed stream 30. Cooling of the second feed stream 30 may also be assisted by one or more other heat exchangers or coolers or refrigerants (not shown in FIG. 1), either related to and/or unrelated to the scheme of the LNG plant shown in FIG. 1.

The cooled feed stream 50 is combined with the first LNG stream 40 at a combiner such as a junction or driver to produce a combined LNG stream 60. The combined stream 60 is then reduced in pressure by passage through an expander 22, preferably a two phase expander. Expanders are well known in the art and are adapted to reduce the pressure of a fluid stream passing therethrough so as to create a liquid stream and gaseous or vapour stream therefrom. The streams 60*a* from the expander 22 can pass through a flash valve (not shown) and then on to an end flash vessel 12, wherein the liquid stream is generally recovered as a product LNG stream 70, and a gaseous stream 80. The product LNG stream 70, having a pressure between 1-10 bar, such as ambient pressure, is then passed by one or more pumps to storage and/or transportation facilities.

The resultant gaseous stream 80 from the end flash vessel 12 can be passed through the heat exchanger 14, through which the second feed stream 30 passes, usually countercurrently. The output of the gaseous stream 90 from the heat exchanger 14 can then be used as a fuel gas and/or used in other parts of the LNG plant.

Table I gives an overview of various data including pressures and temperatures of streams at various parts in an example process of FIG. 1.

TABLE I

| | Stream number | | | | | | | | | |
|---|---|---|---|---|---|---|---|---|---|---|
| | 10 | 20 | 30 | 40 | 50 | 60 | 60a | 70 | 80 | 90 |
| Phase | Vapor | Vapor | Vapor | Liquid | Liquid | Liquid | Liquid | Liquid | Vapor | Vapor |
| Temperature ° C. | 40.0 | 40.0 | 40.0 | −154.0 | −154.0 | −154.0 | −154.8 | −162.5 | −162.5 | 4.9 |
| Pressure Bar | 60.0 | 60.0 | 60.0 | 55.0 | 58.5 | 55.0 | 4.0 | 1.0 | 1.0 | 0.9 |
| Flowrate Kg-mol/sec | 1.00 | 0.98 | 0.02 | 0.98 | 0.02 | 1.00 | 1.00 | 0.94 | 0.06 | 0.06 |
| Composition | % | | | | | | | | | |
| METHANE | 90.00 | 90.00 | 90.00 | 90.00 | 90.00 | 90.00 | 90.00 | 90.70 | 79.32 | 79.32 |
| ETHANE | 5.00 | 5.00 | 5.00 | 5.00 | 5.00 | 5.00 | 5.00 | 5.33 | 0.01 | 0.01 |
| PROPANE | 2.00 | 2.00 | 2.00 | 2.00 | 2.00 | 2.00 | 2.00 | 2.13 | 0.00 | 0.00 |
| IBUTANE | 1.00 | 1.00 | 1.00 | 1.00 | 1.00 | 1.00 | 1.00 | 1.07 | 0.00 | 0.00 |
| NITROGEN | 2.00 | 2.00 | 2.00 | 2.00 | 2.00 | 2.00 | 2.00 | 0.78 | 20.67 | 20.67 |

Further cold energy can be recovered from the output stream 90 from the heat exchanger 14 by one or more further heat exchanges, such as using one or more further heat exchangers.

The arrangement in FIG. 1 has a number of advantages. One advantage is the reduction in the number of heat exchangers needed. Hitherto separate heat exchangers are used for the reject gas and the second feed stream, which will involve additional installations and plant machinery, as well as additional energy requirements. In FIG. 1, there is only one heat exchanger 14 for the direct interaction of the second feed stream 30 and gaseous stream 80.

Another advantage is that the cold energy in the gaseous stream 80 can be recovered up to a temperature of above +0°, possibly up to +20°, +30° or even +40° C. or above, as opposed to hitherto recovering cold only up to a maximum of −40° C. or only −50° C. from a reject gas stream against a standard liquid refrigerant. The wider temperature approach can be used to decrease the cold recovery heat exchanger 14 in general, such as the heat exchanger area. The resultant fuel gas 90 from the heat exchanger 14 is useable at +0°, +20°, +30° or +40° C. or above as an energy source for the plant.

The efficiency (i.e. overall energy running requirement) of the overall LNG plant is therefore benefited by being able to achieve cold recovery from the gaseous stream 80 over its entire temperature range, and by being able to transfer cold directly from the gaseous stream to a feed stream, rather than through one or more intermediate refrigerant streams (with the loss of energy recovery at each exchange).

This efficiency can be demonstrated by comparing the increase in work energy created by the expander 22 in the scheme shown in FIG. 1, compared with for example directly feeding a second feed gas line into the end flash vessel 12. In a typical arrangement for the FIG. 1 scheme, the expander 22 creates 170 KW of work energy for use elsewhere in the scheme, whereas by direct feeding a second feed gas stream into the end flash vessel, the work energy created by the expander 22 is only 166 KW. The FIG. 1 scheme is therefore more efficient.

In a first alternative, the stream 80 is passed to an alternative one or more heat exchangers to recover the cold energy therefrom, said heat exchanger(s) preferably being part of an LNG liquefaction system, such as the liquefaction heat exchanger 18 shown in FIG. 1.

The person skilled in the art will understand that the present invention can be carried out in many various ways without departing from the scope of the appended claims.

What is claimed is:

1. A method of liquefying a hydrocarbon stream from a feed stream, the method at least comprising the steps of:

(a) providing a feed stream;

(b) dividing the feed stream of step (a) to provide at least a first feed stream comprising at least 90% of the mass of the initial feed stream, and a second feed stream;

(c) liquefying the first feed stream of step b) in a first heat exchanger at a pressure between 20 bar and 100 bar to provide a first liquefied natural gas (LNG) stream;

(d) cooling the second feed stream of step b) in a second heat exchanger to provide a cooled feed stream;

(e) combining the first LNG stream of step (c) with the cooled feed stream of step (d) to provide a combined LNG stream consisting essentially of liquid;

(f) reducing the pressure of the combined LNG stream of step (e) by passing the combined LNG stream consisting essentially of liquid through an expander that creates work energy for use elsewhere in the method; and (g) passing the combined LNG stream of step (f) through a flash vessel to provide a product LNG stream and a gaseous stream that is used in the method without recycling to the feed stream.

2. The method as claimed in claim 1 wherein the first feed stream comprises at least 95% of the mass of the initial feed stream.

3. The method as claimed in claim 1 wherein the second feed stream is cooled in step (d) to a temperature of at least −100° C.

4. The method as claimed in claim 1 wherein the second feed stream is between 1% by mass and 5% by mass of the feed stream containing natural gas.

5. The method as claimed in claim 1 wherein the pressure of the product LNG stream is between 1 bar and 10 bar.

6. The method as claimed claim 1 wherein there is no significant pressure change other than any de minimis change of 10 bar or less of the first feed stream between said dividing in step (b) and said combining in step (e).

7. A method as claimed in claim 1 wherein the first feed stream comprises at least 97% of the mass of the initial feed stream.

8. The method as claimed in claim 1, wherein step g) further comprises passing the combined LNG stream of step f) through a flash valve, prior to passing it through the flash vessel.

9. The method as claimed in claim 1 further comprising the step of:

(h) passing the second feed stream and the gaseous stream through the second heat exchanger to at least partly provide the cooling of the second feed stream in step (d).

10. The method as claimed in claim 9 wherein the temperature of the gaseous stream after passing through the second heat exchanger for step (d) is between 30° C. and 50° C.

11. The method as claimed in claim 9 further comprising the step of:

(i) using the gaseous stream outputted from the second heat exchanger as a fuel gas stream.

12. A method as claimed in claim 9 wherein the first feed stream comprises at least 95% of the mass of the initial feed stream.

13. The method as claimed in claim 9 wherein the second feed stream is cooled in step (d) to a temperature of −100° C. or below.

14. The method as claimed in claim 9 further comprising the step of:

(i) using the gaseous stream outputted from the second heat exchanger as a fuel gas stream.

15. A method as claimed in claim 14 wherein the first feed stream comprises at least 95% of the mass of the initial feed stream.

16. The method as claimed in claim 9 further comprising the step of passing the gaseous stream through one or more additional heat exchangers.

17. The method as claimed in claim 16 wherein the temperature of the gaseous stream after passing through the first heat exchanger is above 0° C.

18. The method as claimed in claim 16 wherein the first feed stream comprises at least 95% of the mass of the initial feed stream.

19. The method as claimed in claim 16 wherein the second feed stream is cooled in step (d) to a temperature of −100° C. or below.

20. An apparatus for producing a liquefied hydrocarbon gas from a feed stream, the apparatus at least comprising:

a stream splitter configured to divide the feed stream into at least a first feed stream comprising at least 90% of the mass of the initial feed stream, and a second feed stream;

a liquefying system including at least a first heat exchanger configured to liquefy the first feed stream at a pressure between 20 bar and 100 bar to provide a first liquefied natural gas (LNG) stream;

a second heat exchanger configured to at least partly cool the second feed stream to provide a cooled feed stream;

a combiner configured to combine the first LNG stream and the cooled feed stream so as to provide a combined LNG stream consisting essentially of liquid;

an expander configured to reduce the pressure of the combined LNG stream thereby creating work energy for use elsewhere in the apparatus; and a flash vessel configured to provide a product LNG stream and a gaseous stream for use in the apparatus without recycling to the feed stream.

21. The apparatus as claimed in claim 20 wherein the apparatus further comprises a conduit to pass the gaseous stream through the second heat exchanger.

* * * * *